US008469569B1

(12) United States Patent
Tunnicliffe et al.

(10) Patent No.: US 8,469,569 B1
(45) Date of Patent: Jun. 25, 2013

(54) ILLUMINATED SPORTS BOARD UTILIZING A BATTERY OR SELF-POWERED INTERNAL LIGHT SOURCE THAT IS TRANSMITTED THROUGH THE CLEAR INTERIOR OF THE BOARD IN ORDER TO ILLUMINATE THE BOARD AND ANY LIGHT ALTERING ELEMENTS CONTAINED IN, OR APPLIED TO, THE BOARD

(76) Inventors: William Loftus Tunnicliffe, Los Angeles, CA (US); Richard Winston Humphreys, Santa Monica, CA (US); Steven Gary Goldstein, Marina Del Rey, CA (US)

( * ) Notice: Subject to any disclaimer, the term of this patent is extended or adjusted under 35 U.S.C. 154(b) by 280 days.

(21) Appl. No.: 12/890,655

(22) Filed: Sep. 25, 2010

Related U.S. Application Data

(60) Provisional application No. 61/246,116, filed on Sep. 26, 2009.

(51) Int. Cl.
*F21S 8/10* (2006.01)
*F21V 8/00* (2006.01)

(52) U.S. Cl.
USPC .. 362/545; 362/311.02; 362/511; 280/87.042

(58) Field of Classification Search
USPC 362/459, 511, 543, 311.02, 555; 280/87.042, 280/11.12, 14.21, 87.041, 600, 601
See application file for complete search history.

(56) References Cited

U.S. PATENT DOCUMENTS

| | | | | |
|---|---|---|---|---|
| 4,997,196 | A | 3/1991 | Wood | |
| 5,052,702 | A * | 10/1991 | Chan | 280/11.28 |
| 5,132,883 | A * | 7/1992 | La Lumandier | 362/466 |
| 5,357,409 | A * | 10/1994 | Glatt | 362/105 |
| 6,290,249 | B1 * | 9/2001 | Wolf | 280/609 |
| 6,431,733 | B2 * | 8/2002 | Seifert et al. | 362/459 |
| 6,621,419 | B2 * | 9/2003 | Chiu | 340/815.42 |
| 6,802,636 | B1 | 10/2004 | Bailey | |
| 7,048,284 | B1 | 5/2006 | Seifert | |
| 7,121,676 | B1 * | 10/2006 | Kutnyak | 362/105 |
| 7,232,243 | B1 * | 6/2007 | Nassif | 362/459 |
| 7,445,218 | B2 * | 11/2008 | Esposito et al. | 280/87.042 |
| 7,845,816 | B2 * | 12/2010 | Lombard et al. | 362/106 |
| 7,942,450 | B2 * | 5/2011 | Kawano et al. | 280/816 |
| 8,038,313 | B1 * | 10/2011 | Campbell | 362/183 |
| 8,052,293 | B2 * | 11/2011 | Hurwitz | 362/84 |
| 8,083,238 | B2 * | 12/2011 | Borges | 280/11.203 |
| 2003/0185019 | A1 * | 10/2003 | Rogers et al. | 362/545 |
| 2004/0100054 | A1 * | 5/2004 | Yang | 280/87.042 |
| 2004/0212980 | A1 * | 10/2004 | Wells | 362/31 |
| 2007/0194558 | A1 * | 8/2007 | Stone et al. | 280/601 |
| 2008/0036165 | A1 * | 2/2008 | Reinson | 280/87.042 |
| 2009/0108554 | A1 * | 4/2009 | Boyle et al. | 280/87.042 |
| 2009/0160143 | A1 * | 6/2009 | Fraley | 280/11.28 |

* cited by examiner

*Primary Examiner* — Alan Cariaso
(74) *Attorney, Agent, or Firm* — Robert W. J. Usher

(57) ABSTRACT

A clear, frosted, or colored, transparent and/or translucent, plastic, or composite skateboard, snowboard, or any sports board material, that is illuminated with replaceable, rechargeable, or self-charging battery powered light emitting diodes which are placed inside the board within an inexpensive, drop-in, modular housing, which serves as a light engine and provides light that is transmitted through the interior of the board itself in order to illuminate light altering elements which are embedded inside the board and/or etched, printed or applied to the surface of the board. This glowing light creates unique artistic light patterns, flashing sequences, and glowing designs throughout the interior and exterior of the board.

42 Claims, 10 Drawing Sheets

ILLUMINATED SPORTS BOARD UTILIZING A BATTERY OR SELF-POWERED INTERNAL LIGHT SOURCE THAT IS TRANSMITTED THROUGH THE CLEAR INTERIOR OF THE BOARD IN ORDER TO ILLUMINATE THE BOARD AND ANY LIGHT ALTERING ELEMENTS CONTAINED IN, OR APPLIED TO, THE BOARD

This nonprovisional utility patent application claims the benefit of a prior provisional patent application filed by William L Tunnicliffe, application No. 61/246,116, filing date Sep. 26, 2009.

BACKGROUND OF THE INVENTION

The present invention relates generally to illuminated sports boards and pertains, more specifically, to using compact and powerful LED lights to illuminate skateboards and project light out from the skateboards.

Previous illuminated skateboards apply, affix, insert, or attach light bulbs to existing wooden skateboards in order to project light out from discrete and isolated areas within the board or to project light from discrete and isolated areas attached to the outer surface of the board and/or the truck and wheel assemblies attached to the skateboard. These lights are connected by wire to separate battery power and electrical component compartments that are externally affixed or attached to the sports board and are not easily replaced.

Some examples of illuminated sports boards that affix light bulbs or light strips or light panels to solid, non-clear composite and/or wooden skateboards are seen in the following U.S. patents:

Bailey, U.S. Pat. No. 6,802,636 shows a solid wooden skateboard that has LED lights affixed to a plurality of recesses on the side of the board. Light shines out only from these discrete areas and the board itself is not illuminated. The LED lights are not easily replaceable and the battery compartment is externally attached to the board.

Wood, U.S. Pat. No. 4,997,196 shows a wooden skateboard with a groove around the periphery within which a string of LED lights are permanently embedded and affixed. Skid bars with LED lights mounted in them are also shown with wires that attach to an externally mounted power and battery compartment. These external mountings are bulky and interfere with the normal and traditional operation and riding of the skateboard. If these lights fail due to the normal wear and tear of riding a skateboard, they are not easily replaced. The skateboard itself is not illuminated, the LED lights only project light out from the edge, or surface, of the board.

Seifert, U.S. Pat. No. 7,048,284 shows a wooden skateboard with a peripheral groove and a hollow central slit which hold embedded and affixed LED light strings. These light strings are attached by wires to electrical power components contained within a protective housing mounted between one of the trucks and the bottom surface of the skateboard deck. These electrical connections cannot be replaced by the skateboard user and they add additional weight and bulk to the skateboard.

Seifert, U.S. Pat. No. 6,431,733 shows an electro-luminescent sheet attached to the top surface of the skateboard and covered with a permanent layer of resin for protection. This light source cannot be replaced by the user, and it only serves to project light out from the surface of the solid wooden skateboard.

These inventions only project light out from the LED light source and they do not illuminate the board material itself.

These inventions have bulky external power compartments that alter the weight, appearance, and performance of the skateboards as compared to traditional, non-illuminated skateboards. Additionally, the LED light sources are not easily replaced by the user in the event the LED bulbs break, wear out, or fail to operate properly.

SUMMARY OF THE INVENTION

It is therefore the object of the present invention to provide a unique new style of illuminated skateboard which utilizes a battery or self-powered internal light source that is transmitted through a clear and/or translucent skateboard in order to project light out of the skateboard and to also project light throughout the interior of the skateboard in order to illuminate frosted, colored or translucent graphic elements that are either embedded inside the board, or etched, frosted, or printed on the surface of the board.

Another object of the invention is to provide a compact, modular lighting compartment that holds all the LED lights, power, and electronic control components that are needed to illuminate the skateboard. This LED lighting module is easily removed and replaced by the skateboard user in order to replace batteries, change worn out LED lights, or to switch LED lighting options for customized use.

Another object of the invention is to create an illuminated skateboard that glows from within and also projects light out to the surrounding area.

Yet another object of the invention is to create an illuminated skateboard that has no externally attached or mounted power sources that would alter the accepted and traditional shape and weight characteristics of conventional skateboards. The flexibility characteristics of conventional skateboards can also be matched by using the present invention.

The above objects, as well as further objects and advantages, are attained by the present invention which may be described briefly as an illuminated skateboard that glows and illuminates from within the skateboard itself.

The present invention is comprised of the following components:

- The skateboard component transmits and refracts light from an LED source mounted inside the board itself. The board functions as a light pipe that disperses and transmits the LED light by refraction through the transparent and/or translucent plastic material that the board is composed of. Clear or colored plastics are used as a raw material for the skateboard component. These plastics can also be combined with structural components as stiffening agents to increase rigidity, such as hexagonal plastic webbing, extremely rigid clear plastic strips, carbon fiber rods, wood strips, or metal rods. The skateboard component is a contoured, or flat, elongated oval shape which provides a surface for which to ride on. The composition of the plastics and/or the embedded structural supports provides for a wide variety of choices in the flexibility and rigidity of the board component.
- The lighting component is an inexpensive, drop-in, modular light housing, the light engine, which uses an LED light array to transmit the light throughout the light pipe, the board itself, and through a variety of refractive, reflective, and diffusive light altering elements. This lighting module is placed inside a matching hole or space, which has been pre-bored or molded into the board. This module is easily removed and replaced. Light Emitting Diodes of all different colors are used to provide the lighting component of the illuminated skateboard. These LEDs are small enough to fit inside the board. They are arranged in an outward facing pattern, from a 1 degree to 360 degree pattern, within a small, inexpensive, modular, drop-in plastic housing which is inserted, or embedded, into a pre-molded hole in the board. If no visible wiring is to be seen, the rechargeable LED lighting module is placed in the clear, frosted, or colored plastic, or composite, skateboard directly above the skateboard trucks and wheels. In the case of lighting compartments which have replaceable batteries or show visible wiring connections to a wheel based battery recharging system, the LED module can be placed anywhere within the board. This LED compartment can be cylindrical, square, hexagonal, or any shape desired so long as it fits, in height, within the thickness of the board and provides the desired transmission of the LED light source. This lighting module also holds the battery and electronic devices used to power the LEDs. The LED bulbs surround these electronics and face out into the interior of the skateboard in a 1 degree to 360 degree spread, in order to project, or shine, light through the interior plane of the clear plastic board. Bulbs can also be placed facing up or down as an option to shine light up and out of the module, or down below the module. The LED light can also be directed through fiber optic light tubes emanating from the light engine and embedded in the board, or through additional LED lights attached by wires to the central LED lighting module. The LEDs inside the lighting module are turned on by passing a magnet over a magnetic switch inside the lighting module, or by pushing a watertight, sealed, flush mounted toggle switch on the top of the module, or the top or bottom, of the board.

The light catching components of the board are frosted, outlined, colored, mirrored, dyed or printed patterns which are embedded inside the board, or etched, scratched, printed, or physically applied onto the outer surface of the board. These patterns provide a reflective, refractive, light altering component, which afters the light emitted from the embedded LEDs and shines brightly. Additional light altering components include any frosted or light altering materials embedded within the board which can reflect, block, or after the LED light and create distinctive patterns, graphics, or artwork. Fluorescent and phosphorescent patterns can also be embedded within the board, or mixed into the plastic composition itself in order to after the light.

The electronic control component includes electronic devices which create many options for flashing, strobing, alternating, and constant shining of the LED light. An on/off switch and an LED driver are also included in the electronic control component. This electronic control component is built into the modular, drop-in, LED light housing and provides a wide variety of options for inexpensive removal and replacement.

A power source component provides power for the LEDs and is also contained within the LED lighting module. If the battery is not rechargeable, it is mounted on top of the lighting module which is affixed in the board. A sealed top opens to provide for replacement of the used power cell. The battery component can also be a rechargeable based power system which uses either an external recharger, an axial driven generator, or a self enclosed magneto generator embedded inside the board. The generator is wired to the batteries or super capacitors inside the LED lighting module. In the case of the magneto generator, the magneto generates a small charge every time a small magnet, embedded inside the skateboard wheel below the pickup, turns past it. This charge is sent to the batteries or super capacitors inside the lighting compartment and gradually recharges them. For snowboards, other boards, or non-mechanically recharging skateboards, the rechargeable system utilizes an external recharger to recharge the batteries.

A customized truck component provides additional lighting options. The self-contained, drop-in, LED lighting module, which includes batteries and electronics, provides the user with the choice to use any traditional wheel and truck assembly to attach to the board, unlike other illuminated skateboards which use custom trucks to house power and electronic controls for lighting systems. Even if the LED module is self charging, traditional truck and wheel assemblies can be used, with the exception of the wheels themselves which must have an embedded magnet within at least one wheel but are, in all other respects, identical to traditional wheels. However, the LED lighting module can also be augmented with an optional custom LED truck and wheel assembly in order to provide greater power, additional lighting options, additional battery options, or additional light transmission from the custom truck that adds to, augments, modifies and/or enhances the light transmission in the board above, such as adding a complimentary flashing strobe pattern, providing a headlight projection that strobes in synch with the glowing board, or providing a variety of light effects that are controlled by the LED lighting module and work in conjunction with the glowing board above this custom wheel and truck assembly.

A personalized artistic component of the board is provided by external scratching from repeated use and/or deliberate scratching or etching, printing or dyeing. This external scratching, or any marks that frost, etch, or add light altering properties to the surface of the board, will also catch light from the embedded LEDs and shine. This is an additional design element for the user of the board and is a unique component completely unlike any existing illuminated skateboard designs. Personalized, custom designs will glow, as will scratches from ordinary use. The board user can buff out these scratches to diminish the glow, leave them as is to maintain the glow, or add to the scratches to enhance the glow. The board user can also attach traditional grinding rails, or runners, to the bottom of the board to further control the degree of scratching, and the consequent addition of glowing elements, that occurs. The internal nature of the light source combined with the affect it has on translucent or refractive elements added to the surface of the board, provides a unique and widely varied opportunity to customize the boards with additional glowing elements and designs. Another unique artistic opportunity is created by laminating, or embedding into the center of the board certain clear materials, such as rigid acrylics, that can fracture easily within the shatterproof polycarbonate exterior. Any cracking or fractures inside the board, within the rigid core, will be contained by the flexible, durable exterior and this cracking will catch the light and provide additional glow to the board. The degree to which these fractures occur can be enhanced or diminished by the composition of the core and will provide an additional aesthetic choice for the user of the board.

These components work together to create a unique glowing skateboard, which is illuminated by an inexpensive, drop-in, LED lighting module that serves as a light engine. This light engine provides a light source that is transmitted through the interior of the board itself, and refracted through a variety of light altering substances inside the board and on the surface of the board, in order to create a wide variety of light patterns and designs that are unlike any other skateboard lighting effects. These lighting effects are unique because they are created from inside the material of the board, through the transmission of a light source that is emanating from within the board itself.

The clear plastic skateboard can be injection molded with a single plastic polymer, or a combination of different polymers, or it may be laminated with multiple layers of the same plastic, or it may be laminated with multiple layers of different plastic sheets, such as acrylic, polyethylene, polypropylene and polycarbonate. These different layers are used to combine the properties of these plastics in order to provide a virtually unbreakable plastic exterior with a rigid plastic interior. This lamination, and/or injection molding process, is used to create a clear plastic board that matches all the characteristics of a traditional wood board, such as flexibility and durability. It also provides for a wide variety of new options in the flexibility and durability of the board. The clear plastic boards can be augmented with embedded structural supports, such as metal strips, rigid plastic bars, hexagonal plastic sheets, or wood rods, to further control the flexibility of the board. This same variety of rigidity versus flexibility is attained in crystal clear boards, without any embedded structural supports, by combining, through injection molding and/or lamination, a core of clear, highly rigid plastic with a clear, highly flexible, extremely durable, and virtually shatterproof plastic, such as a polycarbonate, which forms the exterior of the board. Varying the composition of this mix provides a wide range of flexibility for the boards while maintaining a shatter resistant exterior surface on which to ride. Clear illuminated snowboards, surfboards and other boards can also operate in all the same ways as their traditional wood, metal, Styrofoam, or composite counterparts and the same techniques for manufacturing the clear material can also provide a similarly wide range of flexibility in all these types of sports boards.

The illuminating LEDs are placed inside the board within a self-enclosed, sealed modular housing. There can also be multiple LED modules placed inside the board in multiple locations. These multiple light modules have the ability to communicate to each other via modulated light, or hard wiring, in order to create multiple synchronized lighting patterns and effects. The LED modules can also be molded permanently into the board and connected with wires to a removable battery and electronic compartment. Additional LEDs can also be molded permanently into the board and connected to the main, self-enclosed, removable LED module with wires to provide additional illuminating graphic elements. The LED light engine can also transmit light through fiber optic tubes which are attached to the LED bulbs and direct the transmission of the light to specific points inside the board or out to the outer edge, top, or bottom surface of the board, creating points of light that project outward, up, or down from the board. These fiber optic tubes create an artistic pattern or design within the board and can vary the amount of light they leak out in order to provide a wide array of options for additional light patterns within the board design. With respect to these fiber optic tubes and the refraction of light from a central LED light engine, the inexpensive, modular, drop-in LED light housing can be used in conjunction with fiber optic tubes to provide an embedded LED lighting system for existing wooden laminated skateboards, or snowboards. For this system, the fiber optic tubes can be glued, in any desired pattern, into a single layer of plywood, or molded into a sheet of plastic or composite material, which will be used in the existing seven-layer skateboard lamination process. The fiber optic tubes will all originate from one common point in the plywood, where the drop-in, modular LED light engine will be placed either during, or after the lamination process. This fiber optic/plywood sheet will then be laminated into a traditional wooden skateboard, the lighting module will be connected, and this process will create a single piece, wooden skateboard with embedded points of LED light projecting out from inside of it. A single sheet of clear polycarbonate with frosted edges can also be used in the traditional lamination process to create a clear, central, polycarbonate layer within the seven-layer wooden lamination process. The frosted edges of this sheet will catch the light from the LED light engine embedded in the wooden board and create a glowing core. Additional holes bored into the wooden skateboard layers and filled with clear polycarbonate during the lamination process would direct additional light out from the central polycarbonate core of the board, down from the bottom of the board, or up from the top of the board. These unique applications combined with the inexpensive modular light compartment that can be replaced, or recharged, will create a glowing skateboard from traditional wooden lamination that does not use externally applied light bulbs like existing illuminated skateboard designs employ. Another method for retrofitting an existing laminated wooden skateboard is to bore thin holes for the fiber optic tubes to feed through the core of the horizontal plane, or thickness, of the board and connect to one or more LED modules that have been placed into the wooden board by boring out a hole which receives and secures the module into the board, either above the trucks or in other locations.

The clear, frosted, or colored transparent, or translucent, plastic or composite board material used in conjunction with the LED lighting module can also be used to create illuminated boards for other sports which use boards to ride, float, or glide on: such as longboards, streetboards, vigorboards, freeboards, caster boards, snowboards, skis, surfboards, parachute sky surf boards, wind surfing boards, skim boards, paddle boards, boogey boards, snow sleds, water skis, and kayaks.

The system of using an embedded LED lighting module which shines inside of a clear, frosted, or colored translucent material in order to make embedded elements glow can also be used to create any injection molded, laminated, or shaped clear or translucent illuminated object, such as illuminated bicycle helmets, motorcycle helmets, martial arts headgear, car racing helmets, paintball armor, hunting vests, kneepads, wrist guards, or any safety gear that will glow brightly during day or night and provide greater safety for the wearer.

The embedded LED lighting module which shines inside of a clear, frosted, or colored translucent object in order to make embedded elements glow can also be used in a wide variety of toys, toy vehicles, action figures, cases, covers, purses, shoes, fashion accessories, and any other objects which can be molded into a clear substrate within which the LED light engine transmits light.

DETAILED DESCRIPTION OF THE INVENTION

Figure 1:
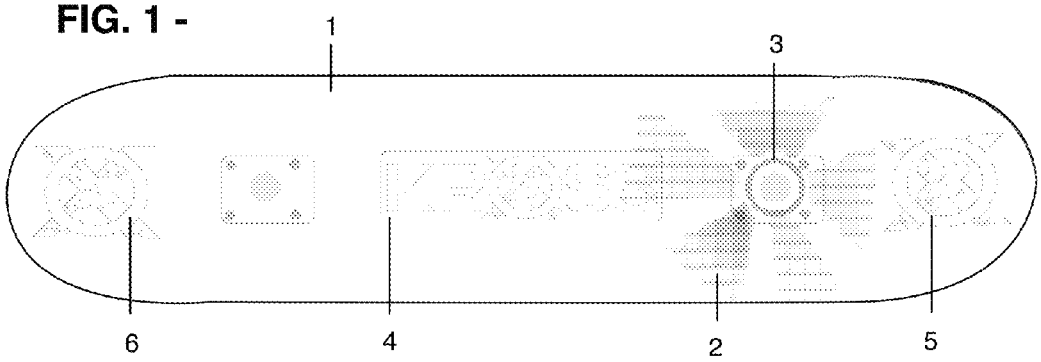
FIG. 1 shows a top view of a clear plastic skateboard illuminated by the LED lighting module inserted in the board.

FIG. 1 shows a top view of a clear plastic skateboard 1 illuminated with LED light beams 2 which emit from the LED lighting module 3 inserted in the board. Embedded graphic components 5 and surface etched graphic components 4,6 are shown to indicate how the graphic components catch light beams 2 from the LED module 3 and glow within the board and on the surface of the board.

Figure 1A:
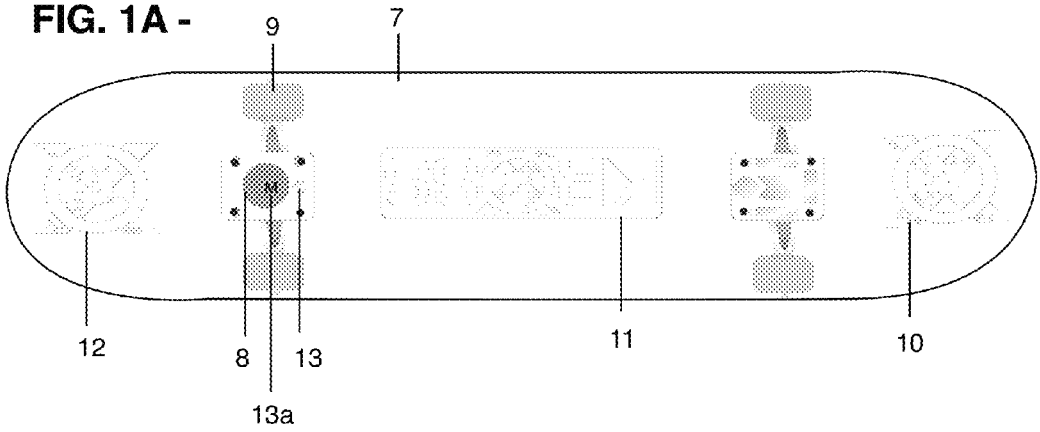
FIG. 1A shows a bottom view of the clear plastic skateboard and the placement of the LED lighting module.

FIG. 1A shows a bottom view of the clear plastic skateboard 7 and the placement of the LED lighting module 8 which is inserted in the board above the truck and wheel assembly 9 so that the module is flush to both the top and bottom surfaces of the board. Embedded and surface etched graphic components 10, 11, 12 are shown to indicate how they catch light from the LED module. The placement of a push button on/off switch 13 is indicated, and the letter "M" 13*a* indicates the placement of another type of on/off switch that is comprised of a magnetic on/off switch built into the electronic components of the LED module 8.

Figure 1B:
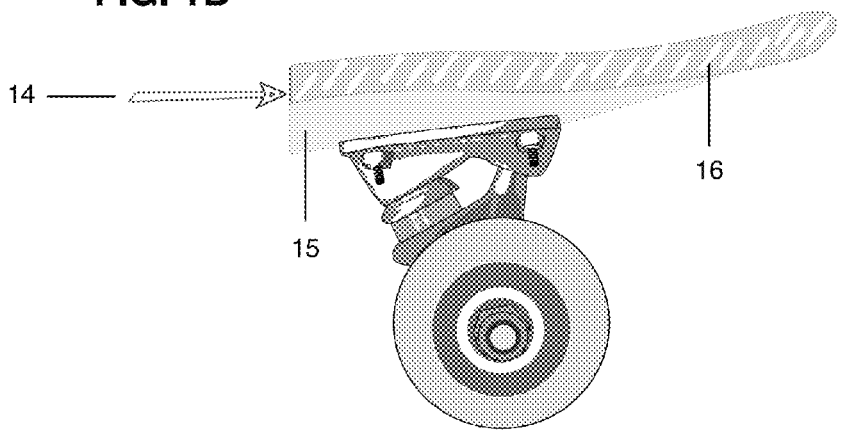
FIG. 1B shows a detail side view of the LED light beam.

FIG. 1B shows a detail side view of the LED light beam 14 traveling through the board 15 and illuminating the frosted edge of the board 16.

Figure 2:
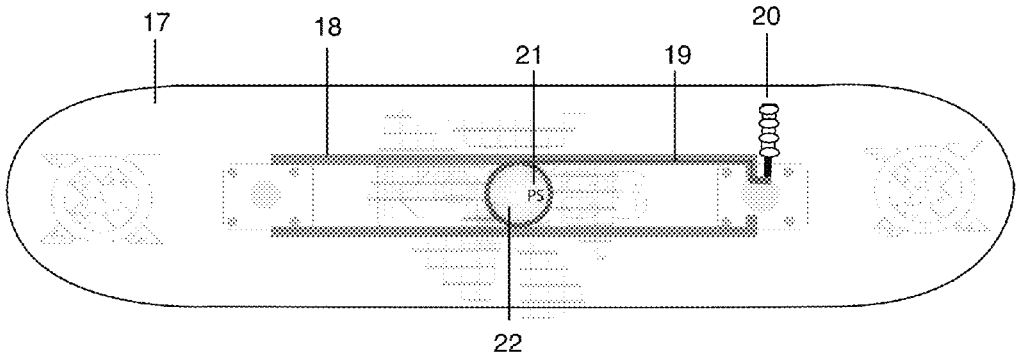
FIG. 2 shows a top view of a clear polycarbonate skateboard that has embedded structural support rods.

FIG. 2 shows a top view of a clear polycarbonate skateboard 17 that has embedded structural support rods 18 for added rigidity. The embedded supports 18 also include wires 19 which connect the magneto 20 to the rechargeable battery and recharge power supply components, labeled "PS", 21 inside the LED lighting module 22, which is mounted in the center of the board.

Figure 2A:
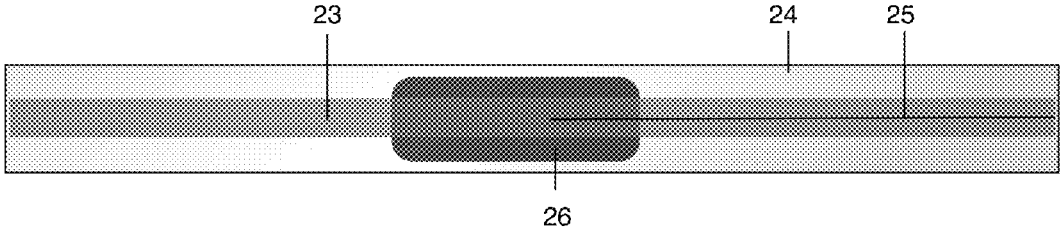
FIG. 2A shows a side view of the embedded structural supports.

FIG. 2A shows a side view of the structural supports 23, such as carbon fiber rods, embedded in the clear skateboard 24. Wires 25 run inside the embedded structural supports 23 and connect to the electronic components inside the LED lighting module 26.

Figure 2B:
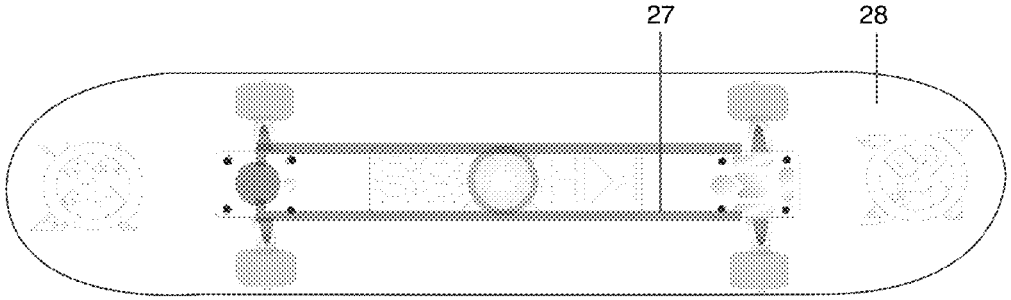
FIG. 2B shows a bottom view of structural support rods.

FIG. 2B shows a bottom view of structural support rods 27, such as steel, rigid acrylics, and carbon fiber rods, embedded in the clear injection molded all polycarbonate plastic skateboard 28.

Figure 3:
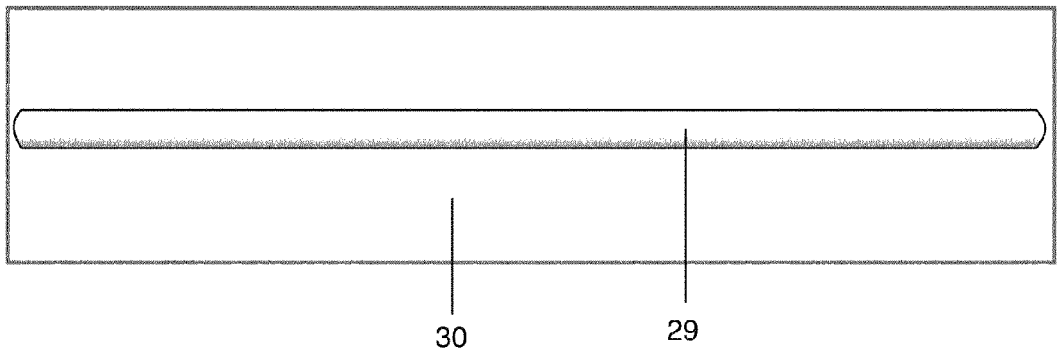
FIG. 3 shows a detail side view of structural supports.

FIG. 3 shows a detail side view of structural supports 29, such as steel, rigid acrylics, and carbon fiber rods, embedded in the center of a clear injection molded all polycarbonate plastic material 30 in order to add rigidity and support to the skateboard which is the same thickness as traditional seven-ply laminated wooden skateboards.

Figure 3A:
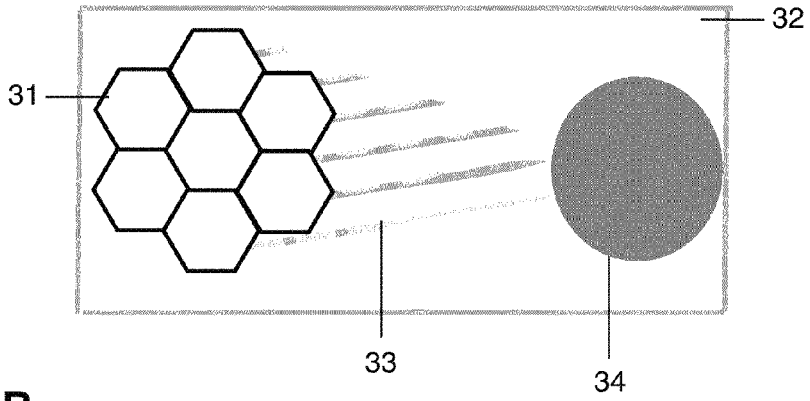
FIG. 3A shows a detail top view of translucent support elements.

FIG. 3A shows a detail top view of translucent honeycomb plastic support elements 31 embedded in the clear plastic material 32 to increase rigidity and to catch light from the LED light beam 33 which emanates from the LED light module 34.

Figure 3B:
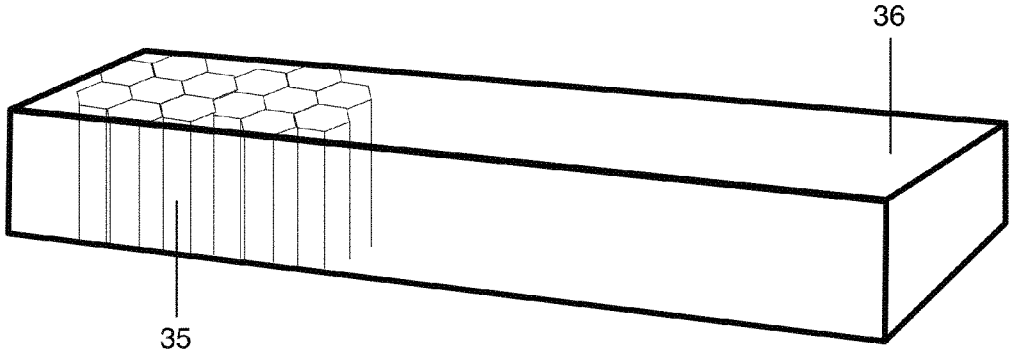
FIG. 3B shows a detail side view of honeycomb plastic support elements.

FIG. 3B shows a detail side angle view of honeycomb plastic support elements 35 embedded in the clear plastic material 36 to increase rigidity. This honeycomb material 35 can be arranged as a graphic element that catches light by utilizing frosted, colored, or printed hexagonal plastic material 35.

Figure 4:
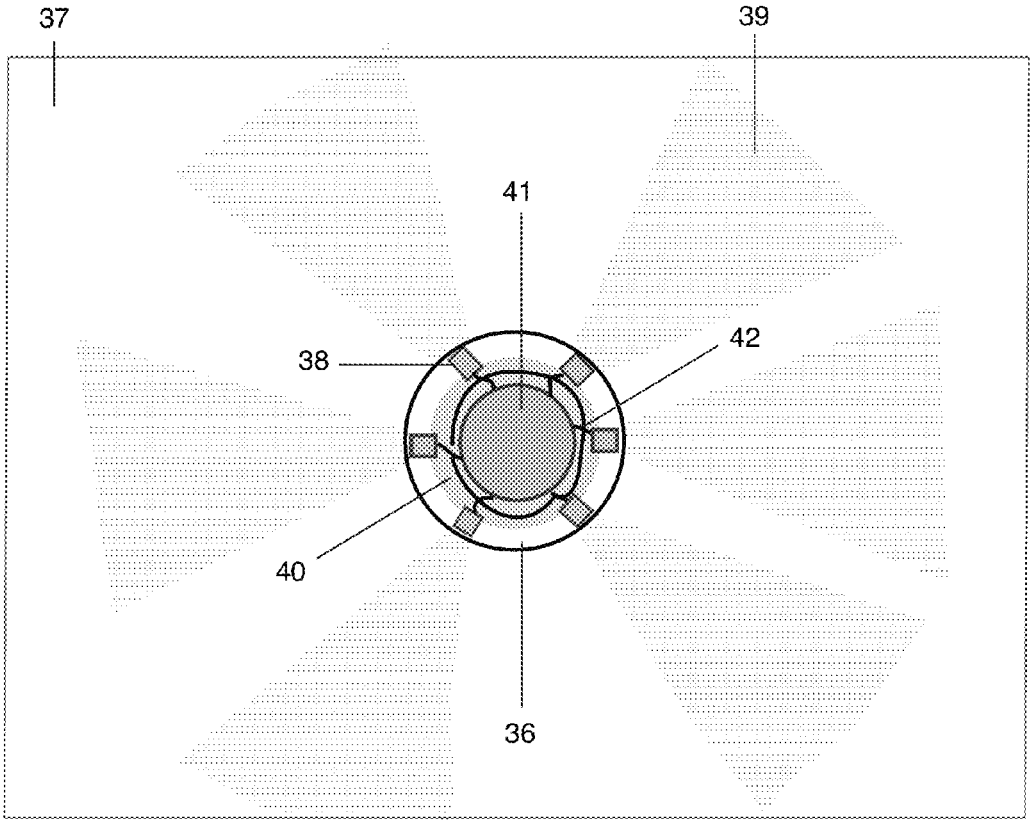
FIG. 4 shows a detail top view of the LED lighting module.

FIG. 4 shows a detail top view of the LED lighting module 36 which is mounted flush within the clear plastic board 37, and which holds outward facing LED bulbs 38 that shine light beams 39 throughout the interior of the board. The electronic control components 40 lie at the base of the lighting module 36 and are connected to the LED bulbs 38 and the rechargeable battery and/or super capacitor and switch components 41 with wires 42.

Figure 4A:
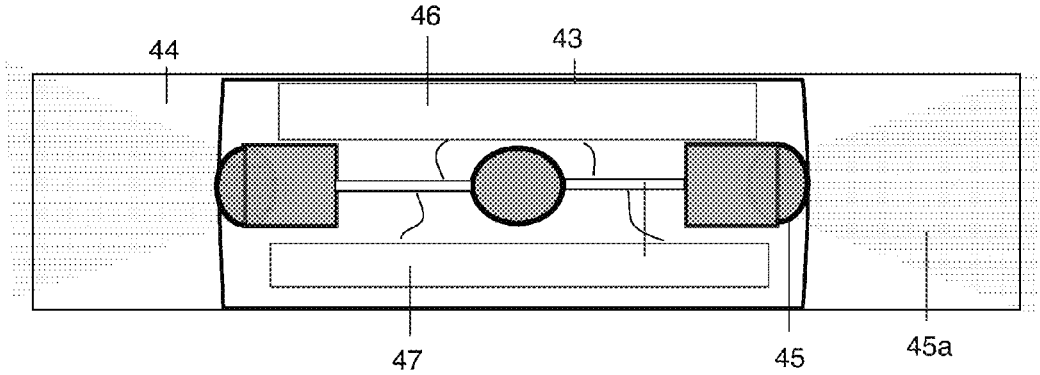
FIG. 4A shows a detail side view of the LED lighting module.

FIG. 4A shows a detail side view of the LED lighting module 43 which is mounted flush within the clear plastic board 44, with outward facing LED bulbs 45 that shine light beams 45*a* throughout the interior of the board. Battery and/or super capacitor and switch components 46 are also contained within the module 43 and the electronic control components 47 are contained inside the module on a layer below, or within, the LED bulbs 45.

Figure 5:
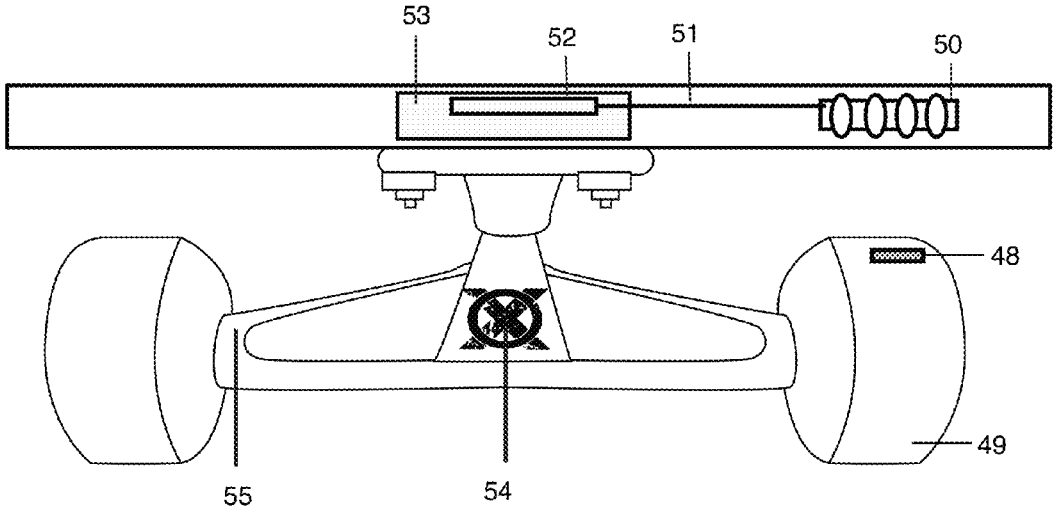
FIG. 5 shows a detail side view of the self-charging power system.

FIG. 5 shows a detail side view of the self-charging power system which indicates the magnet 48 embedded in the skateboard wheel 49 which spins past the magneto 50 embedded in the board, which is connected via wires 51 to the battery components 52 in order to charge the battery and provide power for the LED light module 53. Placement of the company trademark 54 is indicated on the front of truck assembly 55 of the wheels.

Figure 5A:
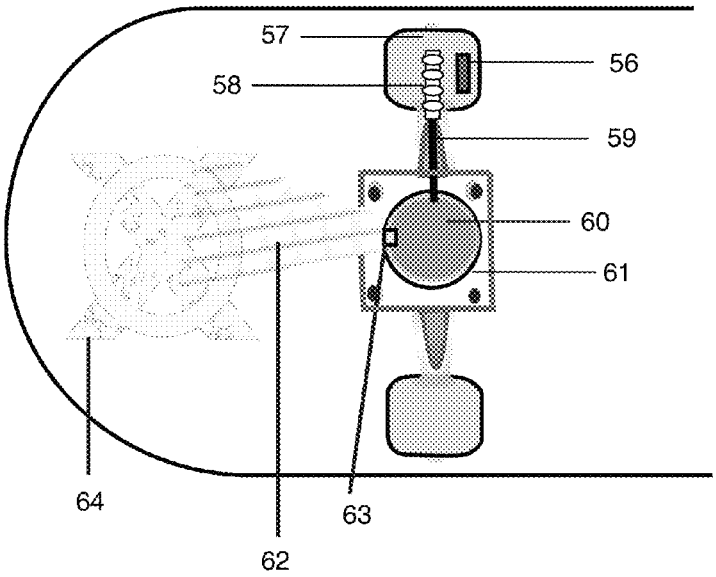
FIG. 5A shows a detail top view of the self-charging power system.

FIG. 5A shows a detail top view of the self charging power system which indicates the magnet 56 embedded in the skateboard wheel 57 which spins past the magneto embedded in the board 58 which relays a charge through the wires 59 connected to the battery components 60, recharges the battery, and provides power for the LED light module 61 which shines light beams 62 from the LED bulbs 63 in order to illuminate the graphic elements 64 embedded in the board.

Figure 6:
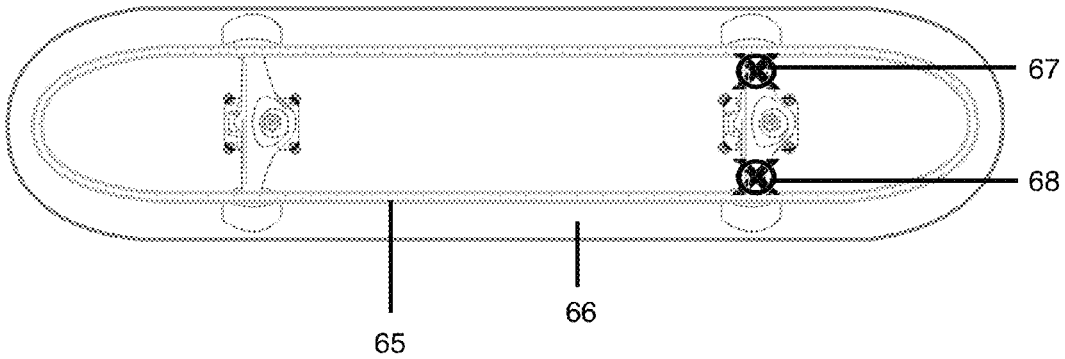
FIG. 6 shows a top view of a method for embedding additional LED lights into the skateboard.

FIG. 6 shows a top view of a method for embedding additional LED lights 65 into the skateboard 66 and connecting them with wires to the LED light modules, indicated by a graphic OX symbol, 67, 68 that are inserted into the skateboard 66. The LED modules 67, 68 then control and power these additional LED lights 65.

Figure 6A:
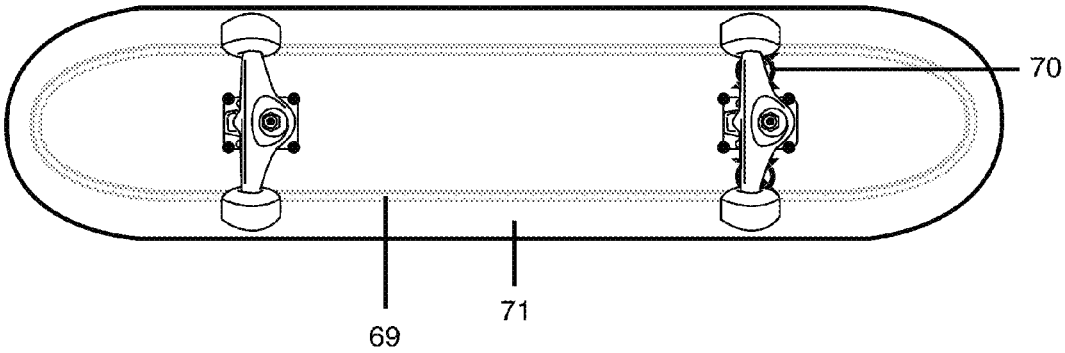
FIG. 6A shows a bottom view of embedding additional LED lights.

FIG. 6A shows a bottom view of a method for embedding additional LED lights 69 and connecting them to the LED light modules 70 that are inserted into the skateboard 71.

Figure 7:
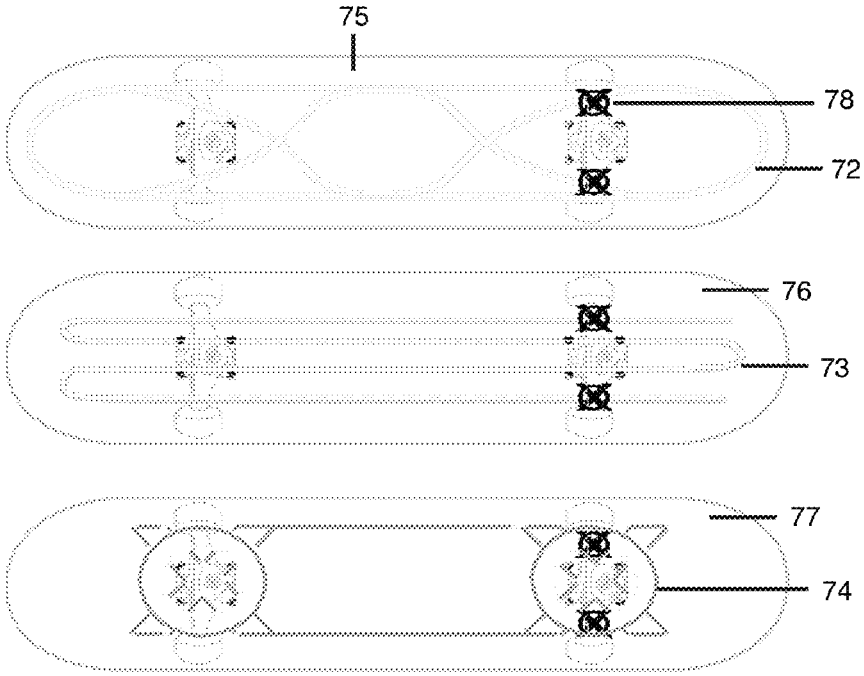
FIG. 7 shows a top view of additional options for embedding additional LED lights.

FIG. 7 shows a top view of additional options for embedding additional LED lights 72,73,74 in the clear skateboards 75,76,77 and connecting them to the LED modules, indicated with the graphic symbol "OX", 78 which power and control the illumination of the additional LED lights 72,73,74.

Figure 7A:
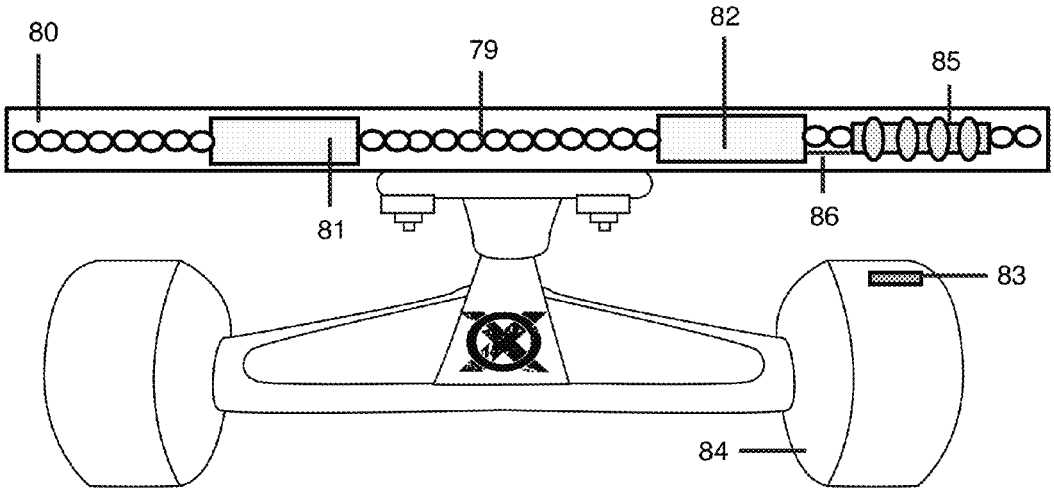
FIG. 7A shows a side view of embedded additional LED lights.

FIG. 7A shows a side view of embedded additional LED lights 79 in the clear skateboards 80 which are connected to two LED modules 81,82 which power and control their illumination. The magnet 83 embedded in the wheel 84 spins past the magneto recharging system 85 which is connected by wire 86 to one LED module 82 in order to power the batteries inside the LED module 82 which will power all LED lights.

Figure 8:
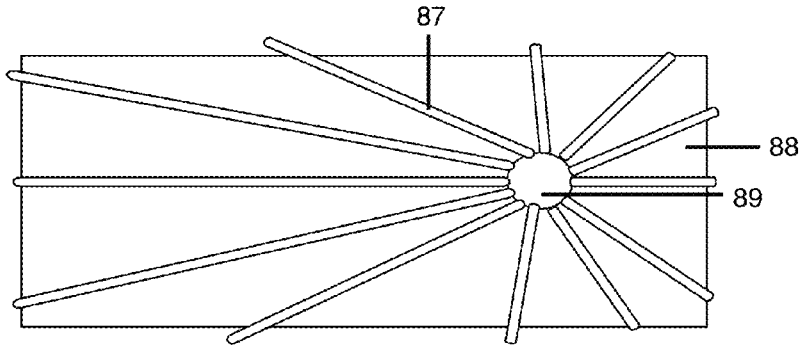
FIG. 8 shows a top view of fiber optic tubes used as the central layer in the traditional seven-layer wooden lamination process.

FIG. 8 shows a top view of fiber optic tubes 87 molded into a solid, non clear, composite sheet 88 which will be used as the central layer in the traditional seven layer wooden lamination process which is currently used to create traditional wooden skateboards. These fiber optic tubes lead to a hole 89 bored into the composite sheet 88 to receive the LED light module and transmit light from the module in order to project light out from the edges of the wooden board.

Figure 8A:
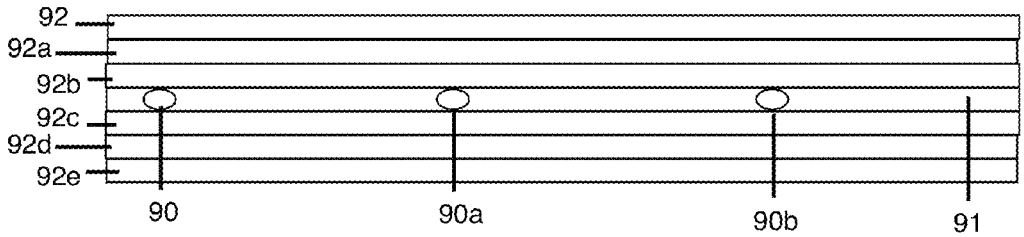
FIG. 8A shows a side view of the fiber optic tubes and the composite sheet embedded between six wooden sheets.

FIG. 8A shows a side view of the fiber optic tubes 90, 90*a*, 90*b* and the composite sheet 91 embedded between six wooden sheets 92,92*a*, 92*b*, 92*c*, 92*d*, 92*e* in order to form the central layer of the traditional seven-layer laminated wooden skateboards and to project light out from the edges of the board through the fiber optic tubes 90,90*a*, 90*b*.

Figure 8B:
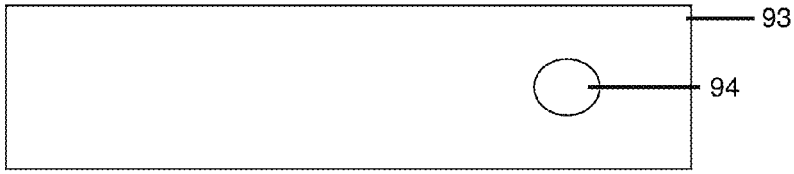
FIG. 8B shows a top view of a clear plastic sheet that will be used as the central layer in the seven-layer wooden lamination process.

FIG. 8B shows a top view of a clear plastic sheet 93 with frosted edges that will be used as the central layer in the seven-layer wooden lamination process, which is currently used to create traditional wooden skateboards. This clear sheet 93 leads to a hole 94 bored into the clear plastic sheet 93 to receive the LED light module and transmit light from the module in order to project light out from the edges of the wooden board.

Figure 8C:
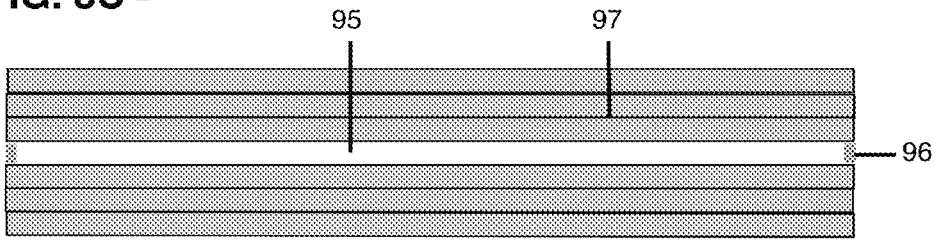
FIG. 8C shows a side view of the clear plastic sheet embedded in the central layer of a seven-layer laminated wooden board.

FIG. 8C shows a side view of the clear plastic sheet 95 with frosted edges 96 embedded in the central layer of a seven-layer laminated wooden board 97 which will be used to make a wooden skateboard with a central glowing core layer 95,96.

Figure 9:
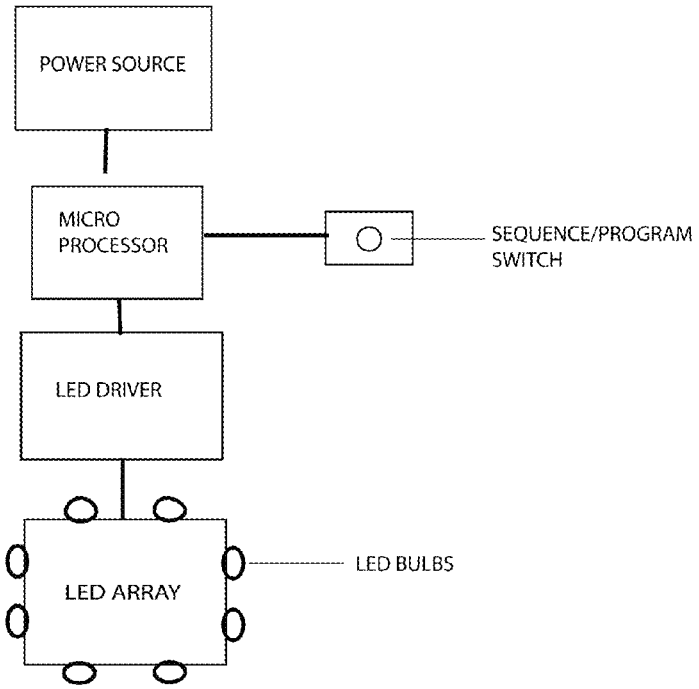
FIG. 9 shows the electronic components for the illuminated skateboard.

FIG. 9 shows a block diagram of the electronic components for the illuminated skateboard.

Figure 9A:
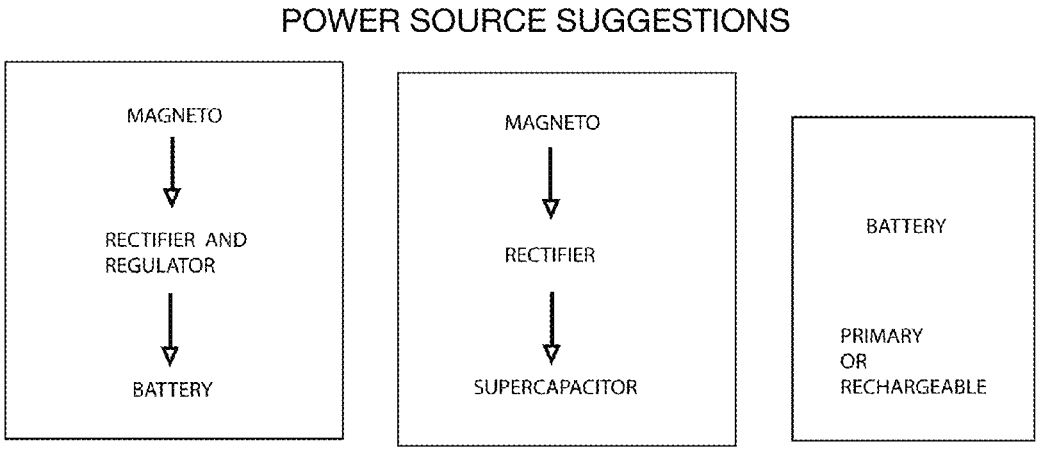
FIG. 9A shows the power source for the illuminated skateboard.

FIG. 9A shows a block diagram of suggestions for the electronics power source for the illuminated skateboard.

Figure 10:
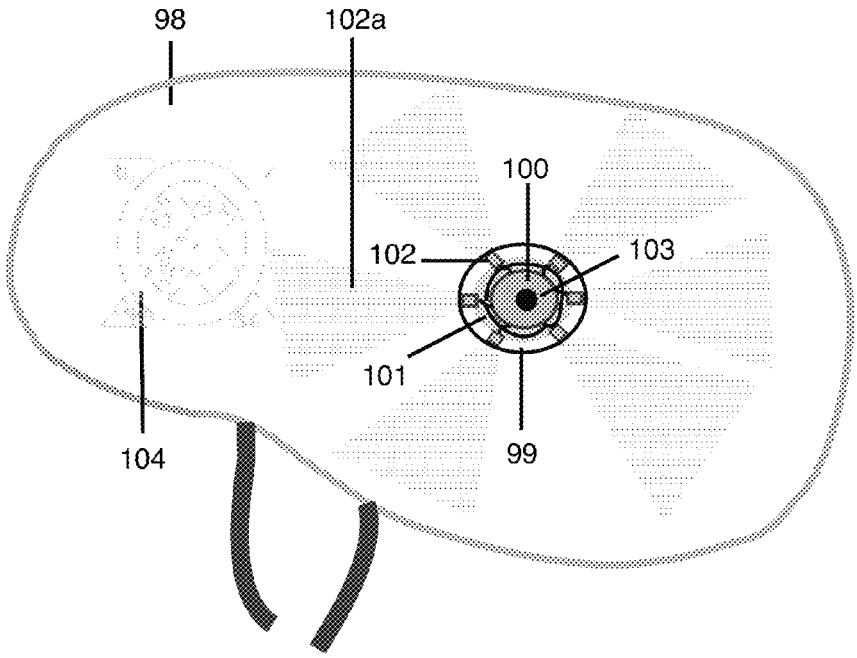
FIG. 10 shows a side view of a clear polycarbonate bicycle helmet that is illuminated by the LED light module.

FIG. 10 shows a side view of a clear polycarbonate bicycle helmet 98 that is illuminated by the LED light module 99 embedded within the helmet material. A replaceable battery and power supply component 100 is housed in the LED light module 99 along with the electronic control components 101, the LED light bulbs 102, and a flush push button control switch 103, which control the LED lights 102 and turn them on and off. The LED light bulbs 102 emit light beams 102*a* which illuminate graphic elements 104 embedded in the helmet 98 or etched onto the helmet surface.

Figure 10A:
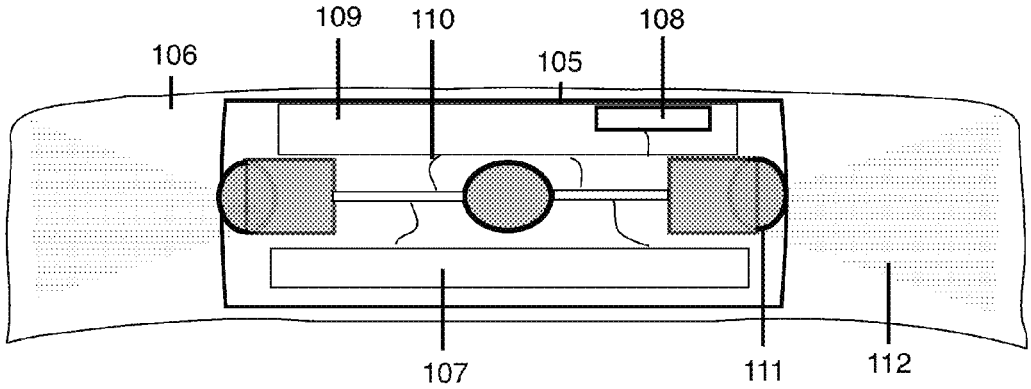
FIG. 10A shows an interior view of the removable LED lighting module embedded flush within the clear polycarbonate material.

FIG. 10A shows an interior view of the removable LED lighting module 105 embedded flush within the clear polycarbonate material 106 of the helmet. The LED module 105 houses the electronic control components 107, switch components 108, a replaceable battery 109 and wires 110 which connect all components to the LED bulbs 111 which are arranged in an outward facing pattern to project light beams 112 out into, and throughout, the interior of the clear polycarbonate material 106.

It is to be understood that the above detailed description of the invention is provided by way of example only. A variety of details of design, construction, and manufacturing techniques may be modified without departing from the true nature and the general scope of the invention as set forth in the appended claims.

The invention claimed is:

1. An illuminated sports board having a self-powered internal light source that is transmitted through a clear and/or translucent sports board material in order to project light out of the sports board and also to project light throughout an interior of the sports board in order to illuminate light altering elements that are either embedded inside the board, or applied to the surface of the board, with the illuminated sports board comprising:

a modular internal light source inserted flush into the sports board that is comprised of outward facing LED lights which are housed within a compact, self-contained module that includes all batteries and electronic components necessary to operate the LED lights, which project out from all surfaces of the board.

2. The illuminated sports board of claim 1 wherein the LED lighting module is replaceable and completely self-contained and is powered by replaceable batteries.

3. The illuminated sports board of claim 1 wherein the LED lighting module is replaceable and completely self-contained and is powered by rechargeable batteries which can be recharged by plugging into an external power recharger.

4. The illuminated sports board of claim 1 wherein multiple LED lighting modules are inserted and/or embedded throughout the sports board in order to illuminate the sports board.

5. The illuminated sports board of claim 1 wherein the lighting module is replaceable and additional LED lights are arranged in a variety of patterns and embedded in the clear and/or translucent sports board material and are connected by wires to, and controlled by, the replaceable LED lighting module in order to further illuminate the skateboard and to provide a wide range of lighting functions and interactions between all the LED lights.

6. The illuminated sports board of claim 1 comprising a clear and/or translucent board material composed of various plastics and polymers which create a clear and/or translucent, variably rigid interior surrounded by a clear and/or translucent, durable, shatter-resistant exterior within which a variety of rigid support elements are embedded to add rigidity; wherein the embedded elements are metal bars, strips or rods; rigid acrylic bars, strips or rods; hexagonal plastic webbing; wooden bars, strips or rods; carbon fiber bars, strips or rods' and rigid composite material shaped into sheets bars, rods webbing or strips in order to provide a wide variety of structural reinforcement and increased rigidity.

7. The illuminated sports board of claim 1 wherein the type of sports board is a skateboard, longboard, streetboard, vigorboard, freeboard, caster board, snowboard, pair of skis, surfboard, parachute sky surf board, wind surfing board, skim board, paddle board, kayak boogey board, snow sled, pair of water skis, and any board sport board.

8. The illuminated sports board of claim 1 wherein light altering minerals and materials that are colored, fluorescent, phosphorescent, and/or reflective are added to the composition of a clear plastic used to form the board in order to further alter the transmission of light within the sports board.

9. The illuminated sports board of claim 1 wherein scratching, etching, polishing, engraving, coloring, and altering the surface of the sports board changes the nature of the light transmitted and provides the user of the board with a wide variety of options for amplifying and modifying the amount of light that shines out from within the illuminated sports board.

10. The illuminated sports board of claim 1 comprising a clear and/or translucent board material composed of various plastics and polymers which create a clear and/or translucent, variably rigid, interior surrounded by a clear and/or translucent shatter resistant exterior; wherein a brittle and rigid clear material is embedded in a central core layer in the interior of the sports board and is surrounded by a more flexible, durable, and shatter resistant clear exterior in order to enable the central core layer to fracture with use internally in order to create more internal light reflection and refraction, without compromising the structural integrity of the board because a fractured central core layer is contained by the flexible, and durable exterior material.

11. An illuminated skateboard having a self-powered internal light source that is transmitted through a clear and/or translucent skateboard material in order to project light out of the skateboard and also to project light throughout an interior of the skateboard in order to illuminate light altering elements that are either embedded inside the skateboard, or applied to the surface of the skateboard, with the illuminated skateboard comprising a modular internal light source inserted flush into the skateboard that is comprised of outward facing LED lights which are housed within a compact, self-contained module that includes all batteries and electronic components necessary to operate the LED lights, which project out from all surfaces of the board.

12. The illuminated skateboard of claim 11 wherein the LED lighting module is replaceable and completely self-contained and is powered by replaceable batteries.

13. The illuminated skateboard of claim 11 wherein the LED lighting module is replaceable and completely self-contained and is powered by rechargeable batteries which can be recharged by plugging into an external power recharger.

14. The illuminated skateboard of claim 11 wherein the LED lighting module is replaceable and is recharged by an electrical connection embedded in the board, which is connected by wires to a magneto generator embedded in the board, which generates an electrical charge every time a magnet embedded in the wheel below it passes the magneto, in order to slowly charge the rechargeable batteries contained within the LED lighting module.

15. The illuminated skateboard of claim 11 wherein multiple LED lighting modules are inserted and/or embedded throughout the skateboard in order to illuminate the skateboard.

16. The illuminated skateboard of claim 11 wherein the lighting module is replaceable and additional LED lights are arranged in a variety of patterns and embedded in the clear and/or translucent skateboard material and are connected by wires to, and controlled by, the replaceable LED lighting module.

17. The illuminated skateboard of claim 11 wherein the lighting module is replaceable and additional LED lights are mounted within or affixed to the skateboard wheel and truck assembly and are connected by wires to, and controlled by, the replaceable LED lighting module in order to further illuminate the skateboard and to provide a wide range of lighting functions and interactions between all the LED lights.

18. The illuminated skateboard of claim 11 comprising a clear and/or translucent board material composed of various plastics and polymers which create a clear and/or translucent, variably rigid interior surrounded by a clear and/or translucent, durable, shatter-resistant exterior within which a variety of rigid support elements are embedded to add rigidity; wherein the embedded elements are metal bars, strips or rods; rigid acrylic bars, strips or rods; hexagonal plastic webbing; wooden bars, strips or rods; carbon fiber bars, strips or rods' and rigid composite material shaped into sheets bars, rods webbing or strips in order to provide a wide variety of structural reinforcement and increased rigidity.

19. The illuminated skateboard of claim 11 wherein the type of skateboard is a longboard, streetboard, vigorboard, freeboard, caster board, and any board with wheels used for any type of skateboard riding.

20. The illuminated skateboard of claim 11 comprising a clear and/or translucent board material composed of various plastics and polymers which create a clear and/or translucent, interior wherein light altering minerals and materials that are colored, fluorescent, phosphorescent, and/or reflective are added to the composition of the clear plastic used to form the board in order to further alter the transmission of light within the skateboard.

21. The illuminated skateboard of claim 11 wherein scratching, etching, polishing, engraving, coloring, and altering the surface of the skateboard changes the nature of the light transmitted and provides the user of the board with a wide variety of options for amplifying and modifying the amount of light that shines out from within the illuminated skateboard.

22. The illuminated sports board of claim 11 comprising a clear and/or translucent board material composed of various plastics and polymers which create a clear and/or translucent, variably rigid interior surrounded by a clear and/or translucent, durable, shatter-resistant exterior; wherein a brittle and rigid clear material is embedded in a central core layer in the interior of the skateboard and is surrounded by a more flexible, durable, and shatter resistant clear exterior in order to enable the central core layer to fracture with use internally in order to create more internal light reflection and refraction, without compromising the structural integrity of the board because a fractured central core layer is contained by the flexible, and durable exterior material.

23. The illuminated sports board of claim 11 wherein the replaceable LED lighting module is recharged via an electrical connection to an axially driven generator which generates a charge as the wheels turn in order to slowly charge the rechargeable batteries contained within the LED lighting module.

24. An illuminated seven-ply wooden skateboard having a self-powered internal light source that is transmitted through a clear and/or translucent central laminated core layer in order to project light out from the edge of the skateboard and also to project light out from a variety of clear and/or translucent plastic-filled, holes or openings that are added to a variety of areas on both the top and bottom surface of the skateboard with the illuminated seven-ply skateboard comprising:

six laminated wooden layers surrounding the central plastic core layer, which, after being joined with the clear central core layer, are carved or molded into shapes which create a wide variety of skateboard forms to be used for balancing on, skateboarding on, or riding on in any manner; and a modular internal light source inserted flush into the skateboard that is comprised of outward facing LED lights which are housed within a compact, self-contained module that includes all batteries and electronic components necessary to operate the LED lights, which project light into and throughout the central laminated layer of the board and transmit that light out from the edges of the board and from any holes or open areas of the board which are filled with clear material.

25. The illuminated seven-ply wooden skateboard of claim 24 comprising a clear and/or translucent sheet of material composed of various plastics and polymers which create a clear and/or translucent, variably rigid central core layer for the seven-ply laminated wooden skateboard; wherein the central core layer is composed of a clear sheet of polycarbonate material with frosted, colored, or light altering edges and a variety of holes in the wooden board are filled with the same polycarbonate material in order to project light up and out from the inside of the skateboard to the top and/or bottom surfaces of the skateboard.

26. The illuminated seven-ply wooden skateboard of claim 24 comprising a clear and/or translucent sheet of material composed of various plastics and polymers which create a clear and/or translucent, variably rigid central core layer for the seven-ply laminated wooden skateboard wherein the central core layer is composed of a solid, non-clear, composite sheet which has fiber optic tubes embedded in the material in order to transmit light out from the LED lighting module to the surfaces and edges of the wooden board.

27. The illuminated seven-ply wooden skateboard of claim 24 wherein the LED lighting module is replaceable and completely self-contained and is powered by replaceable batteries.

28. The illuminated seven-ply wooden skateboard of claim 24 wherein the LED lighting module is replaceable and completely self-contained and is powered by rechargeable batteries which can be recharged by plugging into an external power recharger.

29. The illuminated seven-ply wooden skateboard of claim 24 wherein the LED lighting module is replaceable and is recharged by an electrical connection embedded in the skateboard, which is connected by wires to a magneto generator embedded in the skateboard, which generates an electrical charge every time a magnet embedded in the wheel below it passes the magneto, in order to slowly charge the rechargeable batteries contained within the LED lighting module.

30. The illuminated seven-ply wooden skateboard of claim 24 wherein multiple LED lighting modules are inserted and/or embedded throughout the skateboard in order to illuminate the skateboard.

31. The illuminated seven-ply wooden skateboard of claim 24 wherein light altering minerals and materials that are colored, fluorescent, phosphorescent, and/or reflective are added to the composition of the clear plastic used to form the skateboard in order to further alter the transmission of light within the skateboard.

32. The illuminated seven-ply wooden skateboard of claim 24 wherein the LED lighting module is replaceable and is recharged via an electrical connection to an axially driven generator which generates a charge as the wheels turn in order to slowly charge the rechargeable batteries contained within the LED lighting module.

33. Any illuminated clear board or sheet of material having a self-powered internal light source that is transmitted through the clear and/or translucent material in order to project light out of the material and also to project light throughout the interior of the material in order to illuminate light altering elements that are either embedded inside the material, or applied to the surface of the material, with the illuminated material comprising:

modular internal light source inserted flush into the clear and/or translucent material that is comprised of outward facing LED lights which are housed within a compact, self-contained module that includes all batteries and electronic components necessary to operate the LED lights, which project light into and throughout the interior of the material, and transmit that light out from all surfaces of the material.

34. The illuminated clear board or sheet of material of claim 33, wherein the LED lighting module is replaceable and completely self-contained and is powered by replaceable batteries.

35. The illuminated clear board or sheet of material of claim 33 wherein the LED lighting module is replaceable and completely self-contained and is powered by rechargeable batteries which can be recharged by plugging into an external power recharger.

36. The illuminated clear board or sheet of material of claim 33 wherein multiple LED lighting modules are inserted and/or embedded throughout the material in order to illuminate the object which that material forms.

37. The illuminated clear board or sheet of material of claim 33 wherein the LED lighting module is replaceable and, additional LED lights are arranged in a variety of patterns and embedded in the clear and/or translucent clear or sheet of material and are connected by wires to, and controlled by, the replaceable LED lighting module in order to further illuminate the object which that material forms and to provide a wide range of lighting functions variety of interactions between all the LED lights.

38. The illuminated clear board or sheet of material of claim 33 wherein the illuminated material is injection molded to form an illuminated bicycle helmet.

39. The illuminated clear board or sheet of material of claim 33 wherein light altering minerals and materials that are colored, fluorescent, phosphorescent, and/or reflective are added to the composition of the clear plastic used to form the board in order to further alter the transmission of light within the illuminated material.

40. The illuminated clear board or sheet of material of claim 33 wherein scratching, etching, polishing, engraving, coloring, and altering the surface of the clear board or sheet of material changes the nature of the light transmitted and provides the user of the illuminated object with a wide variety of options for amplifying and modifying the amount of light that shines out from within the illuminated material.

41. The illuminated clear board or sheet of material of claim 33 comprising a clear and/or translucent material composed of various plastics and polymers which create a clear and/or translucent, variably rigid interior surrounded by a clear and/or translucent, durable, shatter-resistant exterior; wherein a brittle and rigid clear material is embedded in a central core layer in the interior of the material and surrounded by a more flexible, durable, and shatter resistant clear exterior in order to enable the central core layer to fracture with use internally in order to create more internal light reflection and refraction, without compromising the structural integrity of the material because a fractured central core layer is contained by the flexible, and durable exterior material.

42. The illuminated clear board or sheet of material of claim 33 wherein the illuminated material is injection molded, laminated, molded carved, or shaped to form a clear or translucent illuminated object, such as illuminated bicycle helmets, motorcycle helmets, martial arts headgear, car racing helmets, paintball armor, hunting vests, kneepads, wrist guards, toys, toy vehicles, action figures, cases, covers, purses, shoes, fashion accessories, and any other objects which can be molded into a clear substrate within which the LED light engine transmits light.

* * * * *